US008215997B2

(12) United States Patent
Hsia

(10) Patent No.: US 8,215,997 B2
(45) Date of Patent: Jul. 10, 2012

(54) ELECTRICAL CONNECTOR

(75) Inventor: Chun-Hua Hsia, TamShui (TW)

(73) Assignee: Advanced Connection Technology, Inc., Taipei County (TW)

( * ) Notice: Subject to any disclaimer, the term of this patent is extended or adjusted under 35 U.S.C. 154(b) by 0 days.

(21) Appl. No.: 12/897,823

(22) Filed: Oct. 5, 2010

(65) Prior Publication Data

US 2011/0195606 A1 Aug. 11, 2011

(30) Foreign Application Priority Data

Feb. 5, 2010 (TW) ..... 99202461 U

(51) Int. Cl.
*H01R 24/00* (2006.01)

(52) U.S. Cl. ..... 439/660

(58) Field of Classification Search ..... 439/660, 439/79, 630, 607.01, 607.41, 352
See application file for complete search history.

(56) References Cited

U.S. PATENT DOCUMENTS

| | | | | |
|---|---|---|---|---|
| 6,435,912 | B1 * | 8/2002 | Zhu et al. | 439/607.23 |
| 7,670,156 | B2 * | 3/2010 | Chen | 439/108 |
| 7,871,297 | B2 * | 1/2011 | Li | 439/607.54 |
| 7,955,136 | B1 * | 6/2011 | Lai | 439/660 |
| 2006/0105630 | A1 * | 5/2006 | Zhang et al. | 439/607 |
| 2009/0156027 | A1 * | 6/2009 | Chen | 439/83 |

* cited by examiner

*Primary Examiner* — Alexander Gilman
(74) *Attorney, Agent, or Firm* — Ditthavong Mori & Steiner, P.C.

(57) ABSTRACT

An electrical connector includes an insulation pedestal, an outer cover, an enhanced shell and a plurality of terminals partially embedded in the insulation pedestal. The insulation pedestal includes a main body and a tongue section. The enhanced shell includes a fixed side and a support side. The fixed side is embedded in the main body; and the tongue section is partially covered by the support side such that the support side can support the tongue section. The insulation pedestal is integratedly formed together with the terminals and the enhanced shell to strengthen the structure of the tongue section.

6 Claims, 5 Drawing Sheets

ELECTRICAL CONNECTOR

CROSS-REFERENCES TO RELATED APPLICATIONS

This non-provisional application claims priority under 35 U.S.C. §119(a) on Patent Application No. 99202461 filed in Taiwan, R.O.C. on Feb. 2, 2010, the entire contents of which are hereby incorporated by reference.

BACKGROUND OF THE INVENTION

1. Field of Invention

The present invention relates to an electrical connector and, in particular, to an electrical connector that has its terminals covered with a metal enhanced shell.

2. Related Art

Accompanying with the advances of technologies, portable electronic devices becomes lighter and thinner. The conventional electrical connectors used on desktop computers are no longer applicable to the portable electronic devices. Therefore, many mini or micro size electrical connector products are further developed; for example, micro USB (Universal Serial Bus) is derived from USB.

FIG. 1A is a conventional micro USB electrical connector. Since the volume is very small, micro USB can be assembled on light and thin portable electronic products such as mobile phone, PDA (Personal Digital Assistance), MID (Mobile Internet Device), PND (Personal Navigating Device) and etc. The micro USB mainly has elements a metal outer cover 10 and a terminal pedestal 20.

FIG. 1B is the terminal pedestal 20 of the conventional micro USB electrical connector. The terminal pedestal 20 has a fixed base 22 with a raised flat tongue section 21. Since the volume of the micro USB electrical connector is quite small, the tongue section 21 is relatively extremely thin; the thickest portion is only about 0.6 mm thick, and the thinnest portion is only about 0.48 mm. In addition, the tongue section 21 is made of plastic so the structure of tongue section 21 very fragile. It is possible for the user to break the tongue section 21 when inserting or pulling out an external connector head.

SUMMARY OF THE INVENTION

Accordingly, the present invention provides an electrical connector that is installed on a circuit board and matchable with an external electrical connector. The electrical connector includes an insulation pedestal with a main body and a tongue section, plural terminals, an outer cover and an enhanced shell with a fixed side and a support side.

The main body is a plastic base. The tongue section is a plastic flat piece raised on the main body. The terminals are long narrow metal strips with their middle sections partially embedded in the insulation pedestal. One end of the terminal is exposed on the surface of the tongue section for electrically connecting with the inserted external electrical connector. The other end of the terminal penetrates out of the insulation pedestal and further extends outwards to be welded on the circuit board. The outer cover is hollow and tubular with its two ends open and is formed from a circled metal plate. The tubular cross-section of the outer cover is rectangular. One end of the outer cover is to match and connect with the external electrical connector, and the other end sheathes outside of the insulation pedestal. The enhanced shell is a flat metal shell piece partially embedded in the main body and partially covering on part of the surface of the tongue section.

An outer contour of the main body is matchable with an inner contour of the tubular cross-section of the outer cover. The insulation pedestal is fixed in the outer cover such that the outer cover circles outside the tongue section without contacting each other. The insulation pedestal is integratedly formed together with the terminals and covers the terminals partially. The fixed side of the enhanced shell is embedded in the main body to fix the enhanced shell on the main body; the support side covers partial surface of the tongue section to support and strengthen the tongue section.

The enhanced shell according to the present invention may be further integrated with the terminals to form a strengthened terminal. One side of the strengthened terminal may raise a width as a strengthened section; wherein the strengthened section has two edges bended in an angle and partially embedded in the main body, with the rest of the strengthened section integrated with the tongue section to strengthen the tongue section in a thickness direction.

According to the present invention, the tongue section of the electrical connector is further protected by the enhanced shell or the strengthened terminals. Therefore, the structure is much stronger than the conventional electrical connector and not easy to be broken, and the usage life will be longer. Meanwhile, it can be formed and manufactured by over injection without increasing massive manufacturing cost.

Preferred embodiments of the present invention and efficacies thereof will be illustrated in detail below with the accompanying drawings.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

Figure 1A:
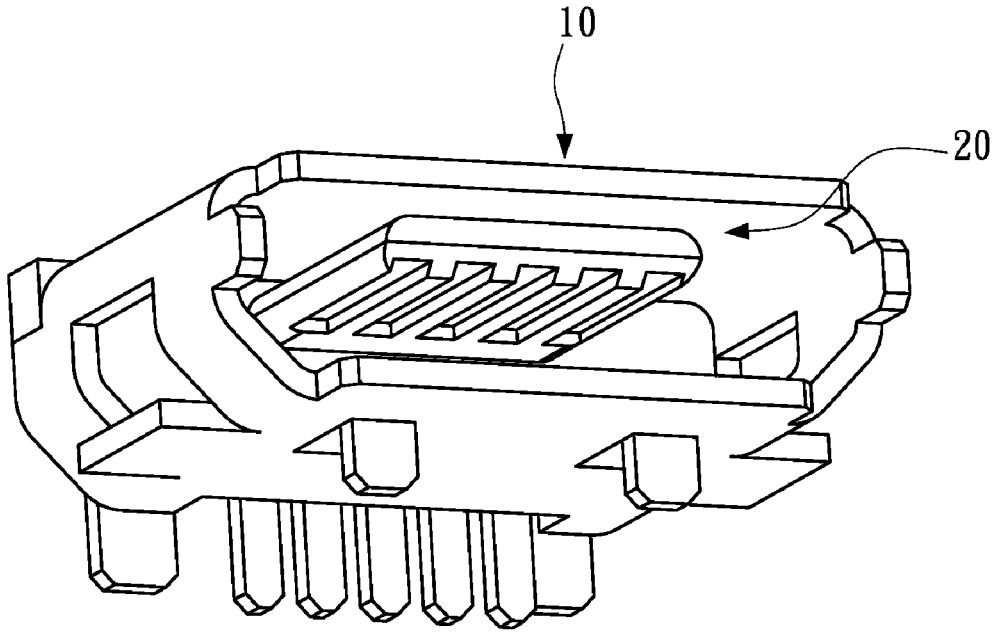
FIG. 1A (Prior Art)
FIG. 1A is an explanatory view of a conventional electrical connector.
Figure 1B:
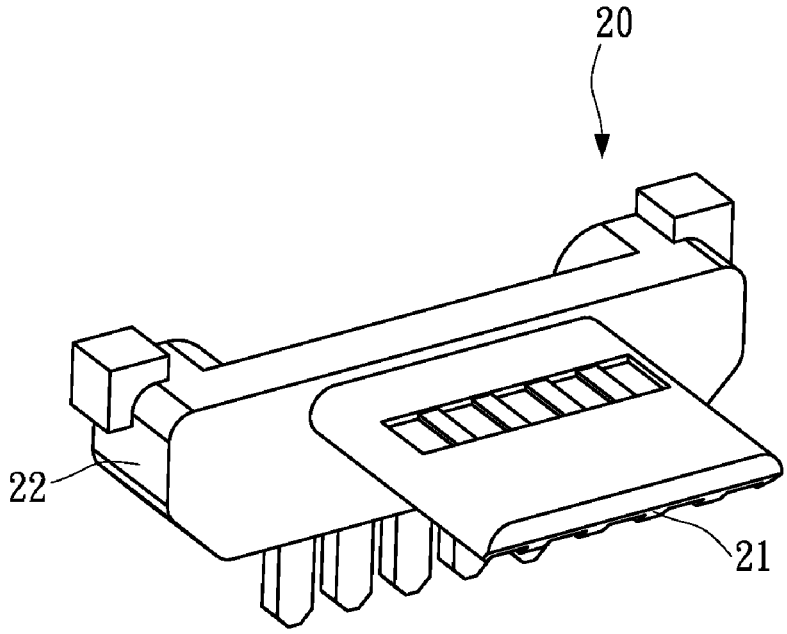
FIG. 1B (Prior Art)
FIG. 1B is an explanatory view of a terminal pedestal in the conventional electrical connector.
Figure 2:
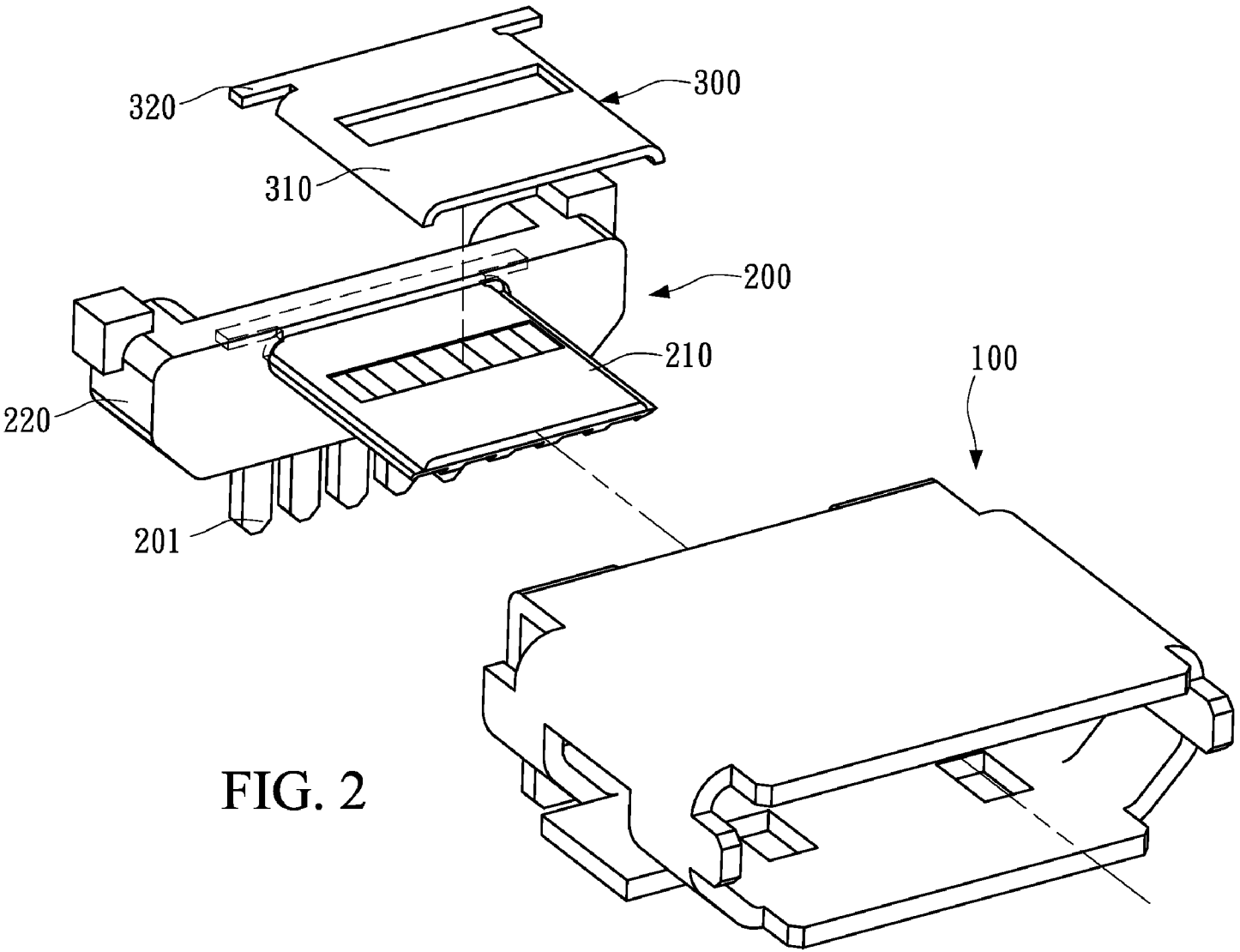
FIG. 2 is an explanatory view according to an embodiment of the present invention.

Referring to FIG. 2, which is an explanatory view according to an embodiment of the present invention. The present invention mainly provides an electrical connector, which has major elements including an outer cover 100, an insulation pedestal 200, plural terminals 201 and an enhanced shell 300.

The insulation pedestal 200 is integratedly formed with a main body 220 and a tongue section 210. The main body 220 is a plastic base. The tongue section 210 is a plastic flat piece raised on the main body. An outer contour of the main body 220 and an inner contour of the tubular cross-section of the outer cover 100 is matchable with each other, so as to fix the insulation pedestal 200 inside the outer cover 100 and make the outer cover 100 circle the tongue section 210 without contacting each other.

The outer cover 100 is hollow and tubular with its two ends open, formed by a circled metal plate. The tubular cross-section of the outer cover 100 is rectangular to protect the insulation pedestal 200. One end of the outer cover 100 is to match and connect with an external electrical connector, and the other end sheathes outside of the insulation pedestal 200.

The terminals 201 are long narrow conductive metal strips with their middle sections partially embedded in the insulation pedestal 200 and integrated together with the insulation pedestal 200. One end of each of the terminals 201 is exposed on the surface of the tongue section 210 for electrically connecting with the inserted external electrical connector; the other end penetrates out of the insulation pedestal 200 and further extends outwards to be welded on a circuit board.

The enhanced shell 300 is a flat metal shell piece, including a fixed side 320 and a support side 310. The fixed side 320 of the enhanced shell 300 is embedded in the main body 220 to fix the enhanced shell 300 on the main body; the support side 310 covers partial surface of the tongue section 210 to support and strengthen the tongue section 210.

Figure 3A:
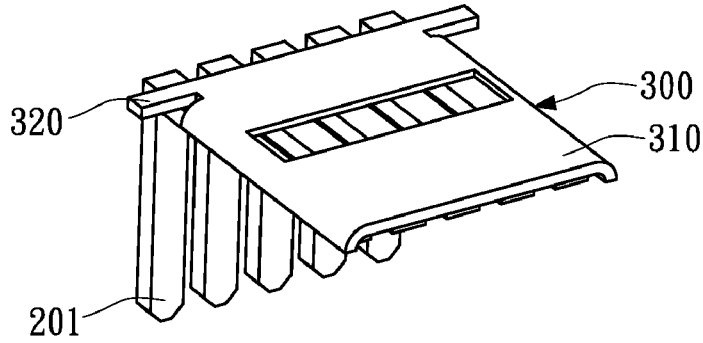
FIG. 3A is an explanatory view of plural terminals and an enhanced shell according to the embodiment of the present invention.
Figure 3B:
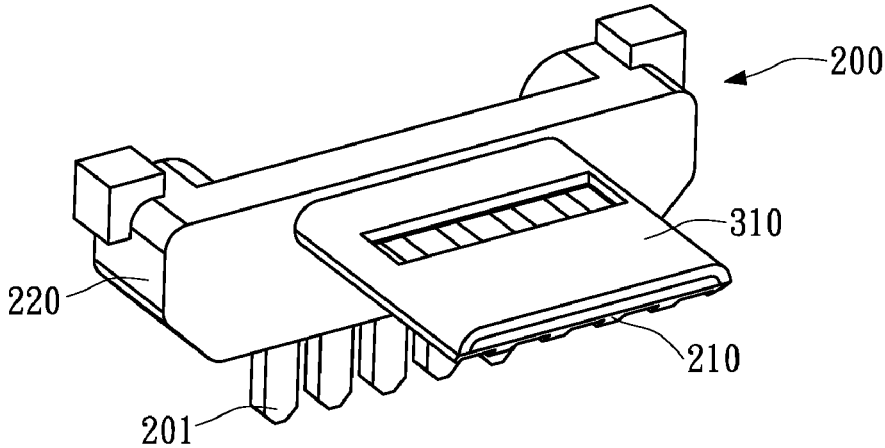
FIG. 3B is an explanatory view of an insulation pedestal according to the embodiment of the present invention.
Figure 3C:
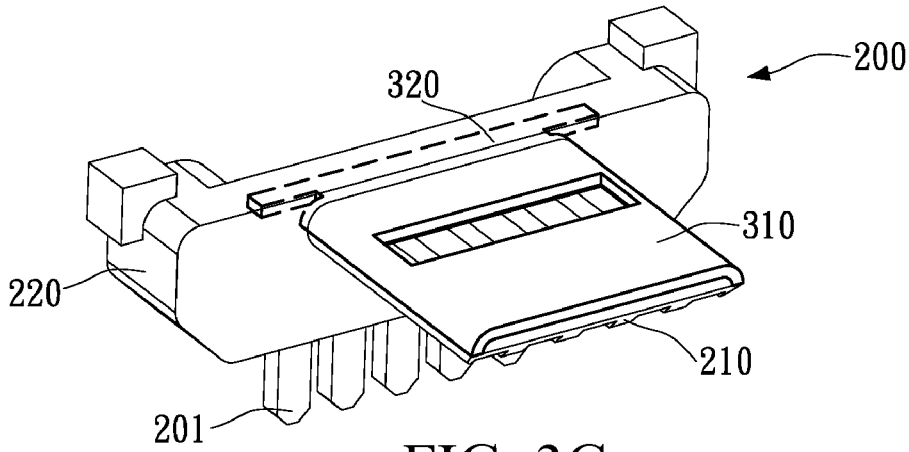
FIG. 3C is a perspective view according to the embodiment of the present invention, illustrating that an enhanced shell is embedded in the insulation pedestal.

Refer to FIG. 3A-3C, which are the embodiments of the electrical connector according to the present invention. FIG. 3A is an explanatory view of plural terminals and an enhanced shell according to the embodiment of the present invention; FIG. 3B is an explanatory view of an insulation pedestal according to the embodiment of the present invention; and FIG. 3C is a perspective view according to the embodiment of the present invention, illustrating that an enhanced shell is embedded in the insulation pedestal;

In FIG. 3A, the terminals 201 is fixed at predetermined position inside a mold, matching the position of the external electrical connector terminals. The present embodiment includes 5 terminals. The enhanced shell 300 is also fixed at a predetermined position inside the mold, covering on the terminals 201. Within the enhanced shell 300 and the terminals 201, the terminals 201 are isolated from each other such that each of terminals 201 may maintain insulated status with any other terminal 201.

As shown in FIG. 3B, after the enhanced shell 300 and the terminals 201 are both positioned in the mold, an over injection procedure is further performed to form the insulation pedestal 200 integratedly. The insulation pedestal 200, enhanced shell 300 and the terminals 201 are then integrated together. One end of each of the terminals 201 is exposed on one side of the tongue section 210 for electrically connecting the external electrical connector terminals; the other ends of the terminals 201 penetrate out of a rear side of the main body 220 and further extend to be welded on the circuit board. Depending on the status installed onto the circuit board, the terminals may be bended in a certain angle; in the present embodiment, the terminals 201 are bended in a certain angle of 90 degrees.

As shown in FIG. 3C, the fixed side 320 of the enhanced shell 300 is embedded in the main body 220 of the insulation pedestal and integrated together; meanwhile, the support side 310 of the enhanced shell 300 covers on the other side of the tongue section 210, opposite to the exposed terminals 201 and integrated together with the tongue section 210. Two edges of the support side 310 are bended in an angle to make the support side a reverse U shape. Also a portion of the support side that is close to the fixed side is partially embedded in the main body 220; in comparison with a pure flat shape, the structures of the bended edges allows the support side 310 to undertake a greater torque stress of bending force.

Figure 4A:
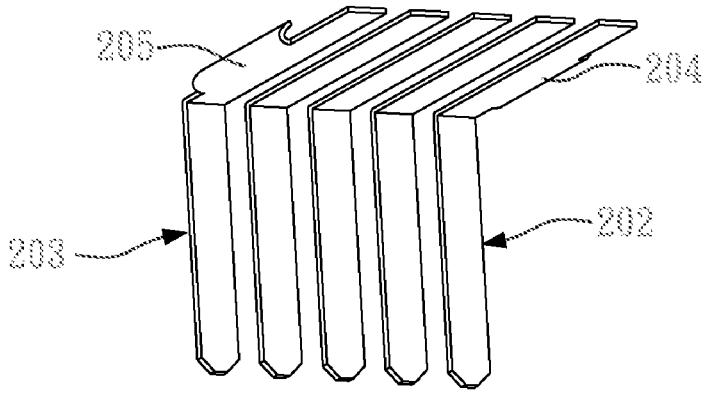
FIG. 4A is an explanatory view according to another embodiment of the present invention.
Figure 4B:
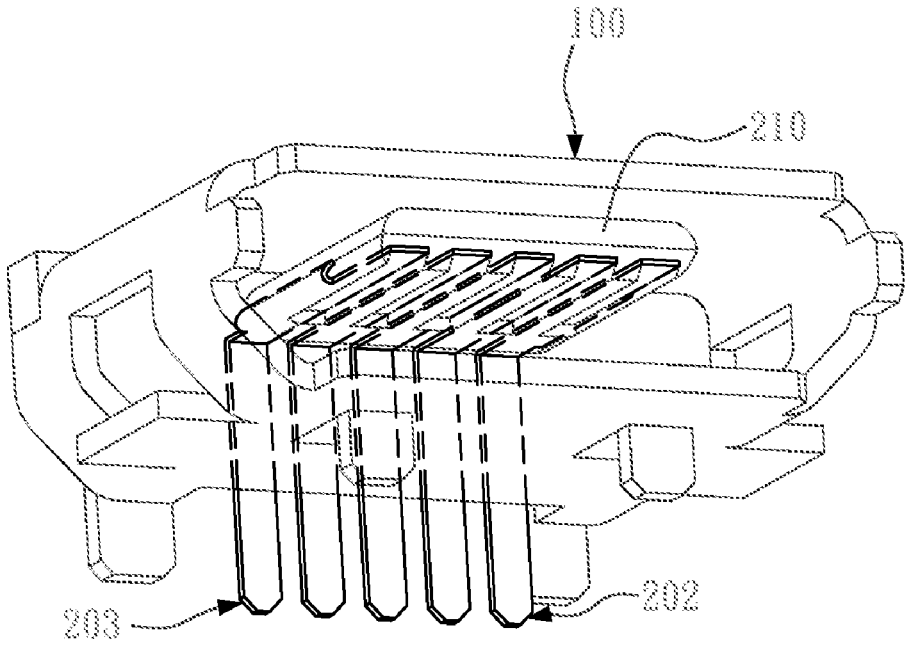
FIG. 4B is a perspective view according to another embodiment of the present invention, illustrating that plural strengthened terminals are embedded in an insulation pedestal.

Refer to another embodiment of the present invention shown in FIGS. 4A and 4B, which are another practices according to the present invention. The enhanced shell 300 of the present invention may be further integrated with the terminals 201, preferably the outer two terminals in the present embodiment, to form two strengthened terminals 202/203. An outer side of each of the strengthened terminals 202/203 raises a width as a strengthened section 204/205. The strengthened sections 204/205 are bended in an angle and preferably to form an arc shape. The strengthened sections 204/205 are partially embedded in the main body 220, the rest portions that are not embedded in the main body 220 may be embedded in the tongue section 210, or covering on the surface of the tongue section 210. In the present embodiment, the strengthened sections 204/205 are covering on the surface of the tongue section 210 (see FIG. 4B).

Figure 5:
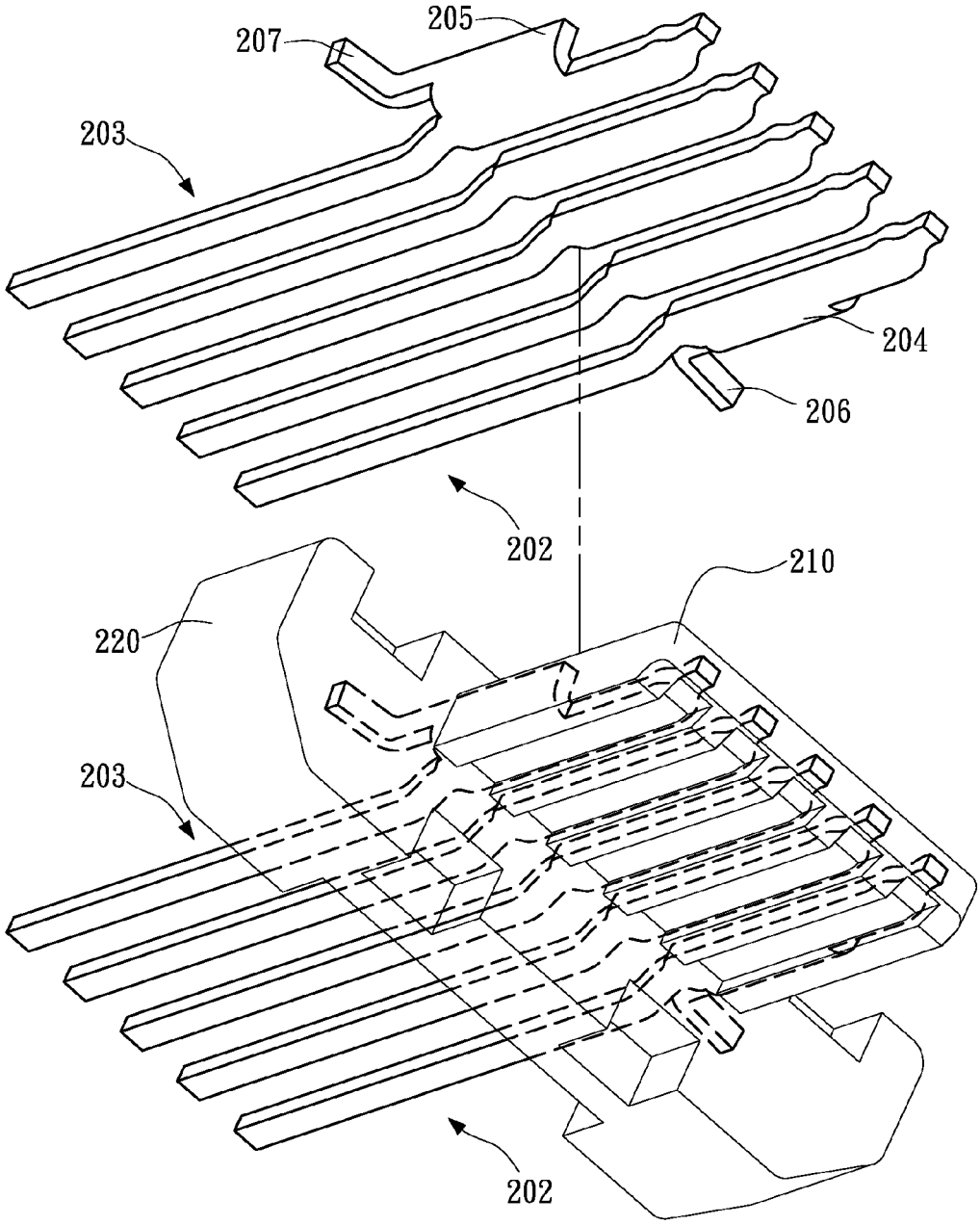
FIG. 5 is an explanatory view according to another embodiment of the present invention.

Refer to FIG. 5, which is another embodiment according to the present invention. The major structures are the same as the last embodiment mentioned above; only the strengthened sections 204/205 further include extension portions 206/207 embedded in the main body 220 respectively. Preferably, the extension portions 206/207 are bended to form an angle with the strengthened section, and are embedded in the main body 220 to enhance the fixing intensity of the strengthened sections 204/205. Therefore, the strengthened sections 204/205 will be more firmly and stably fixed in the main body 220.

The main body 220 here is a compact base that can undertake greater external forces. The tongue section 210 is a plastic flat piece hanging on the main body 220 and fragile than the main body 220. Without appropriate protection, the tongue section 210 could be easily broken when receiving an external force. According to the tongue section 210 disclosed in the present invention, the enhanced shell 300 or the strengthened sections 204/205 can provide sufficient support and outstanding protection efficacy. Such structure is stronger than the conventional electrical connector. Namely the tongue section 210 will be able to undertake a greater torque stress of bending force in a thickness direction and not easy to be broken, thereby having a longer usage life. Meanwhile, it can be formed and manufactured by over injection without increasing massive manufacturing cost.

While the present invention has been described by the way of example and in terms of the preferred embodiments, it is to be understood that the invention need not to be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical connector, installed on a circuit board and matchable with an external electrical connector, the electrical connector comprising:

an insulation pedestal, comprising:

a main body being a plastic base; and a tongue section being a plastic flat piece raised on the main body; and a plurality of terminals being long narrow metal strips aligned in parallel with their middle sections partially embedded in the insulation pedestal, one end of the terminal being exposed on the surface of the tongue section for electrically inserting the external electrical connector, the other end of the terminal penetrating out of the insulation pedestal and extending outwards to be welded on the circuit board, the terminals comprising:

two strengthened terminals, being the two outer ones of the parallel terminals, each of the strengthened terminals having an outer side raising a width as a strengthened section, wherein the strengthened section is bended in an angle to strengthen the tongue section in a thickness direction.

2. The electrical connector according to claim 1, wherein the strengthened section is partially embedded in the main body, and the rest portion of the strengthened section is integrated with the tongue section.

3. The electrical connector according to claim 1, wherein the insulation pedestal is integratedly formed together with the terminals and covers the terminals partially.

4. The electrical connector according to claim 1 further comprising a hollow and tubular outer cover with its two ends open, wherein one end of the outer cover matches and connect with the external electrical connector and the other end of the outer cover sheathes outside of the insulation pedestal.

5. The electrical connector according to claim 4, wherein an outer contour of the main body is matchable with an inner contour of the cross-section of the outer cover, and the insulation pedestal is fixed in the outer cover such that the outer cover circles the tongue section without contacting each other.

6. The electrical connector according to claim 4, wherein the outer cover is formed from a circled metal plate and a tubular cross-section of the outer cover is rectangular.

* * * * *